US008105657B2

(12) United States Patent
Volkov et al.

(10) Patent No.: US 8,105,657 B2
(45) Date of Patent: Jan. 31, 2012

(54) DEVICE FOR APPLYING COATINGS TO LENGTHY PRODUCTS

(75) Inventors: Yuriy Sergeevich Volkov, Moscow (RU); Sergey Vasilievich Marutian, Moscow (RU)

(73) Assignee: Legal and Consulting Agency "JurepromConsulting", Inc. (RU)

( * ) Notice: Subject to any disclaimer, the term of this patent is extended or adjusted under 35 U.S.C. 154(b) by 0 days.

(21) Appl. No.: 12/167,363

(22) Filed: Jul. 3, 2008

(65) Prior Publication Data

US 2008/0268163 A1 Oct. 30, 2008

Related U.S. Application Data

(62) Division of application No. 10/529,518, filed on Oct. 4, 2005.

(30) Foreign Application Priority Data

Sep. 26, 2002 (RU) ..... 2002125583
Jan. 22, 2003 (WO) ..... RU2003000015

(51) Int. Cl.
*B05D 1/18* (2006.01)

(52) U.S. Cl. ..... 427/431; 118/404; 118/405

(58) Field of Classification Search ..... None
See application file for complete search history.

(56) References Cited

U.S. PATENT DOCUMENTS 3,354,864 A * 11/1967 Knapp ..... 118/63
4,860,820 A 8/1989 Pereira
5,042,561 A * 8/1991 Chandley ..... 164/63
5,860,204 A 1/1999 Krengel et al.
2002/0025260 A1* 2/2002 Maruyama ..... 417/322

FOREIGN PATENT DOCUMENTS

| | | | |
|---|---|---|---|
| DE | 3124161 A1 | | 7/1980 |
| FR | 1189624 | | 10/1959 |
| GB | 1546635 | * | 5/1979 |
| GB | 2255351 A | | 4/1992 |
| RU | 94041744 A | | 5/1997 |
| SU | 1568562 A1 | | 6/1988 |
| SU | 1492759 A1 | | 3/1994 |

* cited by examiner

*Primary Examiner* — Dah-Wei Yuan
*Assistant Examiner* — Robert S Walters, Jr.
(74) *Attorney, Agent, or Firm* — McKee, Voorhees & Sease, P.L.C.

(57) ABSTRACT

The inventions refer to method of product surface treatment, technological line and device for hot applying the coating on lengthy products. Line for applying the coating on lengthy product comprising supplying device, product surface preparing unit, devise for continuous applying the coating, cooling camera and final product acceptance unit. Device for applying the coating comprises camera (13) for applying the coating, fixed above the tank (14) with melt. In cover (16) of camera (13) there is an outlet 19 for creating pressure discharge, and in cover (21) of tank (14) there is an inlet (22). Camera (13) is provided with intake vertical passage (20) plunged into the melt of the tank. In the walls of camera (13) there are passages (23) and (24) for product (2) transporting. In working state the melt in the tank (14) and in the camera (13) occupies levels (25) and (26) correspondingly.

6 Claims, 3 Drawing Sheets

DEVICE FOR APPLYING COATINGS TO LENGTHY PRODUCTS

CROSS-REFERENCE TO RELATED APPLICATIONS

This is a Divisional of U.S. application Ser. No. 10/529,518 filed Oct. 4, 2005, which is a U.S. National Phase Application of PCT/RU2003/000015 filed Jan. 22, 2003, which is a PCT of Russian Application Serial No. RU 2002125583 filed Sep. 26, 2002, which applications are hereby incorporated by reference in their entirety.

TECHNICAL FIELD

The inventions refer to technology and technological equipment for lengthy product surface treatment by the material in liquid state and can be used particularly for applying coatings of different kinds (for example, metal protective coatings) on lengthy products such as wire, tubes, rolled products or band by plunging them into the melt of zinc, aluminum, their alloys, tin, lead or others. The inventions can be used for hot aluminizing, zincing or alumo-zincing of cast iron or steel products (by plunging them into the melt) and also for applying, for example, polymer coating on the wire and so on.

BACKGROUND OF THE INVENTION

The analog of the "Line for continuous applying the protective metal coating on the steel lengthy products" is the line for applying the protective metal coating on the tube surface, which includes transporting mechanisms, heating tools, tube bending tools, setting driving housing, tank for the melt and mechanisms for tube delivery and straightening with cooling tools. Bending tool is made in a shape of bent perforated tube of corrosion resistant material, its bent part being placed lower in the tank than melt surface (RU No 22048594).

The disadvantage of this line is the necessity to bend the tube for plunging it into the melt.

The closest analog of the "Line for continuous applying the protective metal coating on the steel lengthy products" is the line for lengthy products hot metallization including tanks placed in sequence and coaxial for fluxing and metallization, plungers with directing rolls placed in them, calibrating device with passage of square cross section, cooling camera with sprayer device and take-in-out mechanism. Calibrating device is made in a shape of fiber (filier) placed inside of the metallization tank with the lengthwise movement possibility. The line is equipped with functional elements speed and tension stabilizer placed in front of the tank, and diverting device placed between plungers and made in a shape of lengthwise vertically stand flat frame with cross dowels having vertical projections in the lower part of the frame and rollers placed in the upper part of the frame with rolling and slipping possibility (SU No 1568562).

For applying the metal coating by means of this line the lengthy product is undergone the bending to plunge it into the tank with melt and following straightening, which complicates line construction and the process of applying the coating.

The analog of the invention "Line for continuous applying the protective metal coating on the steel lengthy products" is the device according to the patent application RU No 998120056. The device comprises the vessel for the tank with melt coating metal, the upper surface of the tank having the opening for bend passage is connected with said vessel, placed under said upper tank surface, and provided with means for inserting the metal band. The device has also the tool for transporting the continuous metal band through said opening and through the tank. This device comprises the plug formed from the hardened metal coating and embracing band at the section run after said opening, while the plug is stationary relatively to the band and has the tool for preventing the tank melt metal flowing out trough said opening and providing the band transporting through the tank at the same time. Besides, there is a tool for cooling the metal coating placed inside said vessel run after said opening for the plug formation and plug fixing during applying the coating on the band, and tool for heating the melt metal tank at the section run after said plug.

Another analog is device for applying the protective coating on the lengthy metal products comprising the tank with heating elements and passage in the bottom of the tank, MGD-lock under the passage with outlet partially inserted into the tank trough the passage. MGD-lock is presented as two L-shaped magnetic circuits with two flat coil of single-phase winding placed at the vertical rods of the magnetic circuits (SU No 492759).

In this device the lengthy product is transported vertically into the tank with melt without bending. The disadvantage of this apparatus is its complication as a result of MGD-lock using.

The devices for applying the coating on the wire, band and so on, in which using of directing roll plunging the product into the melt and transporting it, are known ("Hot zincing guidance", Moscow, "Metallurgy, 1975, p. 376; "Metal coatings of sheet and bar steel" Vitkin A. I., Taidle I. I., Moscow, "Metallurgy", 1971, p. 496).

The disadvantages of the known lines and devices for applying the protective coatings are steel tanks having big volume and significant open melt surface square, which predetermines big power consumption to maintain set temperature of the melt. In particular, the contact of zinc melt with steel walls of the tank and with elements of immersion transporting devices provides iron dissolvent in the zinc and, as a result, shorts the equipment operating period and enlarges zinc consumption.

Using the steel tanks with immersion transporting device excludes the possibility of alloying the melt with aluminum. Ceramic tanks are resistant to the zinc melt alloyed with aluminum but they have a big volume in comparison to steel ones. This is the case because, unlike in the metal tanks where hitting is provided trough the walls, in the ceramic tank hitting is provided through the melt surface.

In the analog device for applying the metal coating on the steel band surface according to the patent application RU No 94041744 the product is entered vertically into the tank with melt through the passage in the bottom of the tank without changing the direction. The preventing of melt flowing out through the passage in the bottom of the tank is provided by means of electromagnetic forces. This force is proportional to the static pressure of the melt metal and opposite to it by the direction. The tank with melt is provided with extra tank for pre-melting, the volume of the tank for applying the coating being several times smaller than one of the pre-melting tank. The level of the melt in the tank for applying the coating is regulated by means of melt moving from the pre-melt tank to the tank for applying the coating. The pre-melting tank is placed aside under the tank for applying the coating. Electromagnetic pumps are provided for melt coating material circulation.

The closest analog of the offered device is the device for applying the metal coatings on the lengthy products comprising tank with the melt and camera for applying the coating (application of France No 7516981, class C23C3/14, 1975).

The camera for applying the coating in this device has input and output passages through which the product is transported while applying the coating is provided. The melt is transported from the tank into the camera for applying the coating by means of the pump. Filling the camera is provided in such a way that the melt level in the camera is set higher than level of input and output passages. The melt is easily flows out the camera into the tank, however the quantity of the melt returning to the camera is a bit more than one flowing out the input and output passages into the tank. It allows maintaining the melt level in the camera for applying the coating higher than one of input and output passages.

The disadvantage of this device is the fact that the melt supply from the tank into the camera is provided by means of immersion pump, which significantly decreases the safety characteristics imposed to the industrial equipment. The continuous melt circulation causes fast wearing of passages and melt contamination with materials from which the passages are made of, which causes deterioration of the coating formation and, therefore, the decrease of its quality.

SUMMARY OF THE INVENTION

In the present inventions the surface treatment, for example, applying the coating on the product surface is provided while the product is transported horizontally through the melt of aluminum, zinc or their alloys, melt of other materials (metal or nonmetal), through the liquid dying substance, flux, solution of organic or inorganic substances and others. The product can be wire, bar, band, rolled products, tube (outer coating) and other lengthy products.

The inventions refer are aimed on safety increase of the line work and refer to surface treatment device included into the line, for example, continuous applying of the coatings, productivity increase. The increase of safety and durability of the line and device is provided by means of the construction simplifying.

The present inventions allow to simplify the method, construction of the line and device for surface treatment (coating applying), simplify technical service, omit product deformation during their treatment due to direct product transporting (without bending). The direct transporting is provided by means of simple and safe holding the material by which the product is treated (solution, melt) from flowing out trough the input and output passages. The inventions provide the increase of the obtained coating quality or the quality of treated product surface due to the regimes presented in the invention, provide the quiet state of the material inside the device for product surface treatment (for example, when aluminizing), and also provide mixing the material with controlled intensity degree (for example, when fluxing) with preventing the flowing out of it.

Achievement of said results and omitting above said disadvantages of the analogs is provided due to the surface treatment and coating applying on lengthy product such as wire, bar, rolled product, band (ribbon), tube, and operated with direct (without bending) transportation of lengthy long product trough the device for applying the coating, in which the liquid is placed (solution, melt). The liquid is, for example, metal melt—aluminum, zinc or their alloys and others, or polymer material melt, or solution of organic or inorganic substance and so on.

Device for product surface treatment, particularly for applying the coating, comprises the tank with liquid, for example, coating metal melt and the camera placed above the tank for applying the coating with input and output passages and intake vertical passage, plunged into the melt in the tank. For the melt lifting from the tank trough the vertical passage into the camera for coating applying the excessive pressure in the tank and pressure discharge in the camera for applying the coating are provided. The pressure differential in the chamber above the camera melt surface and above the tank melt surface is such, that the melt level is above the input and output passages of the camera. The pressure discharge in the camera for applying the coating also serves for preventing the melt flowing out the camera for applying the coating. Therewith the following condition should be maintained:

$P_{at} \geqq P_1 + P_{m \cdot col.}$, where $P_{at}$—atmospheric pressure;

$P_1$—pressure in the camera for applying the coating;

$P_{m.col}$—pressure of the melt column above the lower side of the passage.

In the process of applying the coating the pressure differential $\Delta = P_{at} - (P_1 + P_{m.col})$ is maintained on the constant level to omit the melt flowing out and breaking of atmospheric air into camera through the input and output passages of the camera. Method of product surface treatment, for example, the method of applying the coating, is provided in the appropriate technological line for applying the coating on the surface of lengthy product.

The line comprises the supplying device from which the product relevant to the treatment through the system of directing rollers and straightening device is supplied into the unit for product surface preparing. The unit for product surface preparing comprises the camera for thermal degreasing, the device for mechanical cleaning and/or the product surface preliminary preparing. The product surface preliminary preparing can comprise, in particular, fluxing and thermo-chemical treatment in the inert atmosphere comprising hydrogen.

Than the lengthy product is supplied into the device for continuous applying the coating. This device, which is also an invention, comprises the camera for applying the coating hermetically assembled on the melt tank. The camera for applying the coating and the tank are placed into the housing of the heating oven. The camera for applying the coating in its lower part has intake vertical passage plunged into the melt tank. The camera for applying the coating and the tank are provided correspondingly with input and output passages with outlets for providing the pressure discharge above the melt surface inside the camera and excessive pressure above the melt surface inside the tank.

In the side walls of camera for applying the coating there are input and output passages for treated product passing.

From the output passage of the camera for applying the coating the treated product goes to the cooling camera, from which the cooled final product goes through the transporting device to the unit of final product acceptance. Length of the coated product is not limited while the product does not undergo the bending.

The line for applying the coating requires small production area in comparison to the one for analogs. This is the case due to using the devices for surface preparing and, mainly, due to using the passing through type construction of the device for applying the coating.

The line can be used for applying the protective metal coating on the steel wire, bar, tubes (one-side coating), rolled products. Besides, the line can be used in the plant producing bent shapes. In this case steel bar of the blank bent shape width is used as a coated product. The bent shape producing is accomplished after applying the coating. As a result the final bent shape has coating all over the surface including side edges. Another advantage of the bent shape produced in such a way is the possibility to vary thickness of the metal base and coating depending on operation conditions and specified operation period of the construction.

AN EXAMPLE OF THE INVENTION EMBODIMENT

Method of product surface treatment, applying the metal coating on the surface of the lengthy product in particular, is accomplished in the working process of below described technological lines for continuous applying the coating on the different products.

Figure 1:
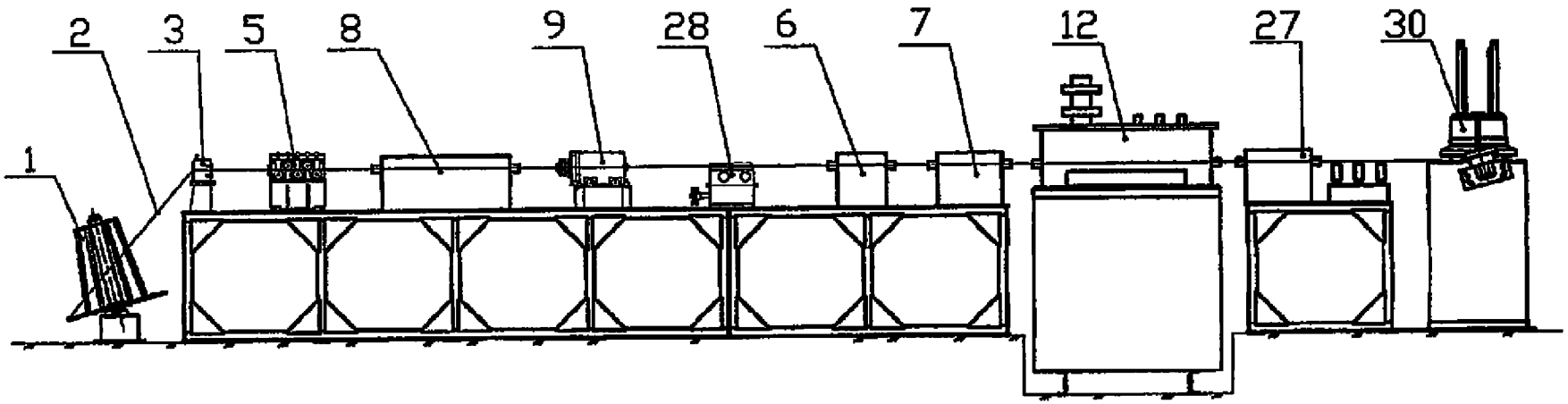
FIG. 1. The principal scheme of the line for continuous applying the protective metal coatings on steel wire.

The line for continuous applying the coating on the wire (FIG. 1) comprises supplying device, for example, two-positioned unwinder 1, from which the wire 2 subjected the treatment is supplied to the straightening device 5 through the roller 3. Straightened wire 2 is supplied to the unit for product surface preparing.

The unit for surface preparing comprises the camera for thermal degreasing 8, device for mechanical cleaning 9, flux applying camera 9 with flux drying camera 7. Instead of the flux applying camera and drying camera it is possible to use cameras for thermo-chemical surface preparing by heating the wire in the protective-reducing atmosphere.

The device for mechanical purifying 9 can be used without fluxing or thermo-chemical surface treatment in the case it provides the good product surface cleaning, particularly jet-abrasive method of cleaning the surface in the jet of hard particles gives good results.

After the device for mechanical cleaning 9 there is transporting device 28 with driving rollers providing wire transporting through the device for mechanical cleaning and necessary force of wire tension.

After surface preparing the wire is supplied to device 12 for continuous applying the metal coatings on the steel lengthy products, in which applying the coating on the product surface is provided. There will be more detailed description of the device 12 construction below.

From the output passage of device 12 for applying the coating the treated product (wire) is supplied to cooling camera 27, in which the coated wire is cooled compulsively. Cooled wire is supplied to the device for transporting and winding wire on coil—reel 30, on which the coated wire is winded uniformly.

Line for continuous applying the metal coatings on steel band-stripe is accomplished in the same way as for wire. The difference is in construction of winding and product transporting units.

Figure 2:
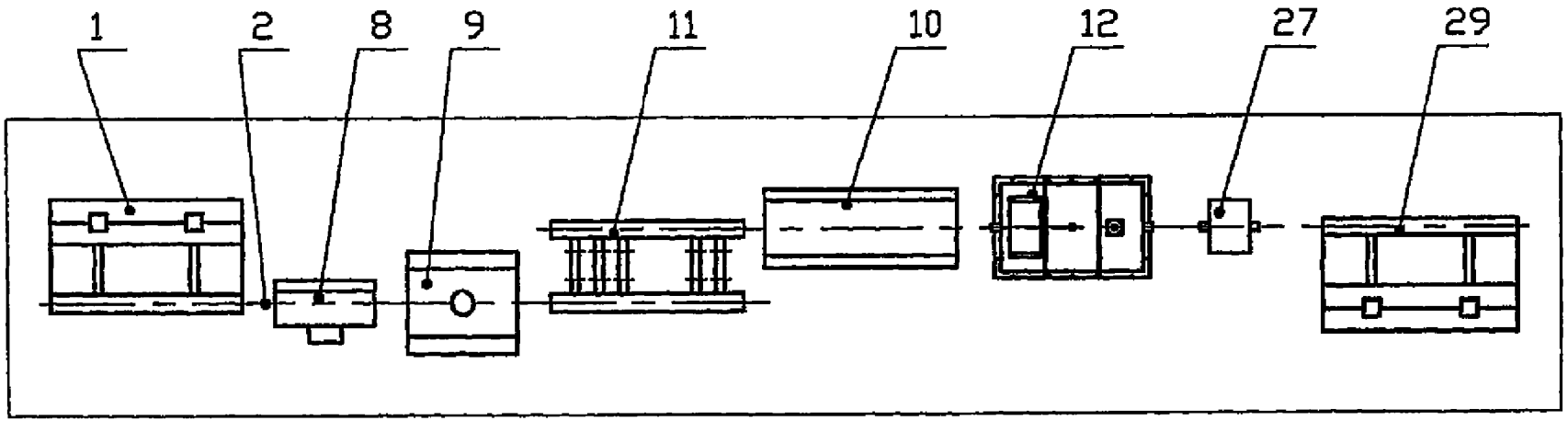
FIG. 2. The principal scheme of the line for continuous applying the protective metal coatings on steel tube or rolled product.

Line for continuous applying the metal coatings on steel tube or rolled product (FIG. 2) has supplying device 1 which is plotter. Unit for preparing the surface of tube or rolled product can comprise the camera of thermal degreasing 8, device for mechanical cleaning 9 and camera 10 for preliminary product surface preparing by thermo-chemical way.

Rolled product or tube is supplied from the plotter to the thermal degreasing camera 8 and the device for mechanical surface cleaning 9 in a shape of measuring fragments. After the device for mechanical cleaning there is plotter 11 for measuring fragments of rolled product and tube and section of connection (welding) of this fragments in "endless length" (not shown on the drawings). This operation is provided because, according to the presented method, applying the coating is accomplished on continuous product.

After the unit for product surface preparing there is a device 12 for continuous applying the metal coatings. Rolled product or tube after leaving the device 12 for continuous coating applying are supplied to the device for removing the melt excesses, and then to the cooling camera 27.

From the cooling device 27 rolled product or tube is supplied to cutting unit, in which the product is cut into measuring fragments. These fragments of rolled product or tube are supplied to the final product acceptance unit 29—final product stacker.

Figure 3:
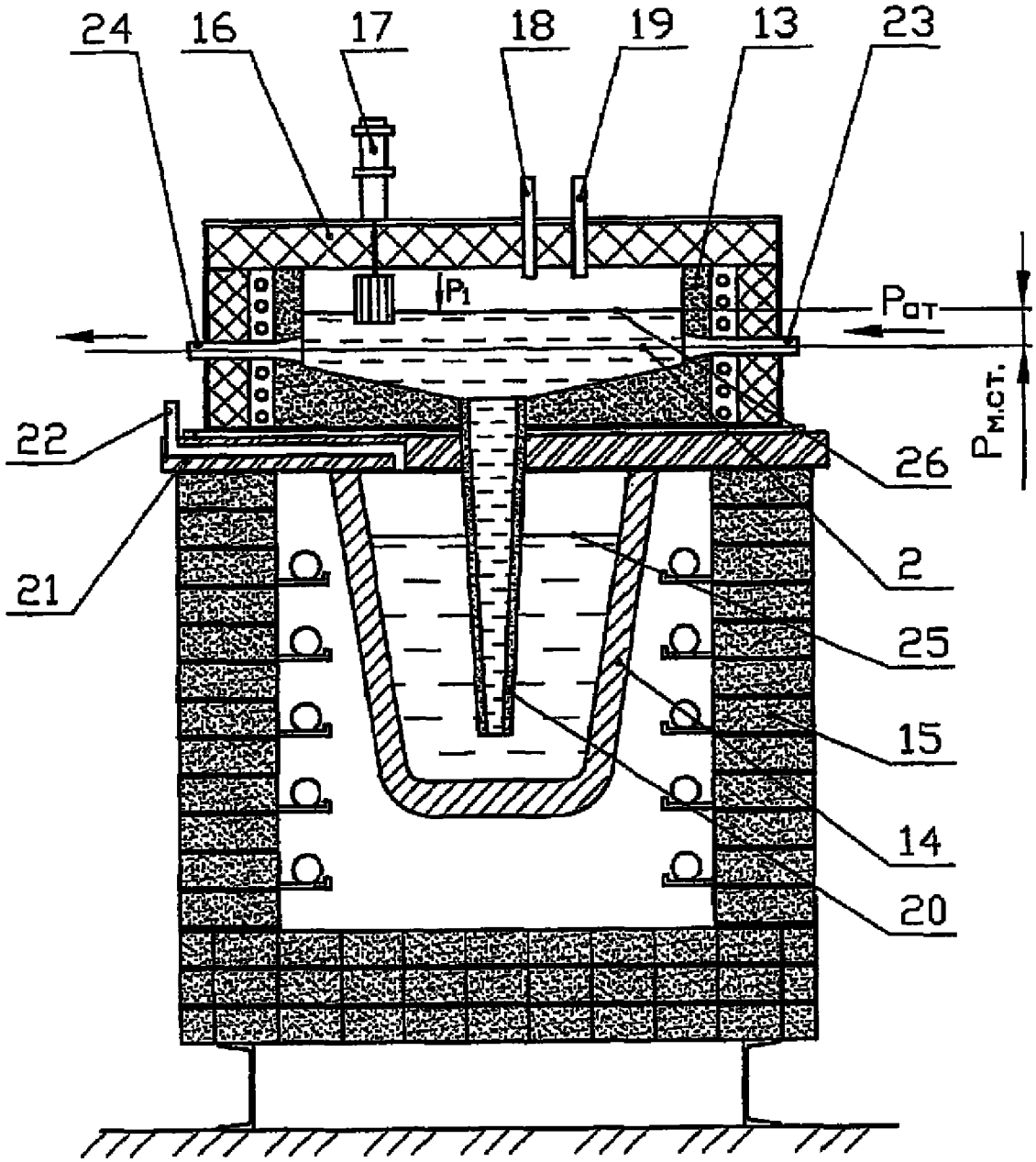
FIG. 3. The general sectional view of the device for continuous applying the protective metal coatings on steel lengthy products.

Device 12 for continuous applying the metal coatings on the steel lengthy products, such as wire, band, rolled products, tube, is made according to the same scheme (FIG. 3). The difference between them is determined only by product cross-section shape and its sizes.

Devise 12 comprises camera 13 for applying the coating is hermetically fixed above the melt tank 14. Camera 13 for applying the coating and tank 14 are equipped by melt heating means, for example, camera 13 and tank 14 can be placed into the housing of the heating oven 15.

Melt level detector 17, manometer 18 and offtake with outlet 19 for pressure discharge are passed through the upper cover 16 of the camera 13. Outlet 19 can be fixed on the wall of the camera 13. Melt tank cover 21 or its wall has intake passage with inlet 22. Both offtake and intake passages are in the air space zone above the melt level, preferably in the tank cover or cover of the camera 13.

In the lower part of the camera 13 there is a intake vertical passage 20, plunged into the tank melt, which provides (if there is pressure differential between camera 13 and tank 14) the possibility of melt supply from the tank 14 to the camera 13 through the passage 20.

In the side walls of camera 13 there are input and output passages 23 and 24 for treated product 2 transporting, the profile of which is determined by the treated product profile cross-section. In the working state the melt in the tank 14 and in the camera 13 occupies levels 25 and 26 correspondingly. Air hollows above the melt level in the camera 13 and tank 14 are not connected with each other.

An example of working process of the line accomplishing the present method and working process of the device for continuous applying the protective metal coatings on wire is presented below.

Wire 2 from the two-positioned rotary unwinder of the supplying device 1 through the system of directing rollers 3 and straightening device 5 is supplied to the welding unit (not shown), and then to the thermal degreasing camera 8, mechanical cleaning device 9, flux applying camera 6 and drying camera 7.

Then the product is supplied to the device for applying the coating.

Under the creation of excessive pressure in the tank 14 through the inlet 22 and pressure discharge in the camera 13 through the outlet 19 the melt goes from the tank 14 to the camera 13 through the vertical passage and is set on the level higher of the input 23 and output 24 passages.

If the following condition is maintained $P_{at} \geq P_1 + P_{m.col}$, where $P_{at}$—atmospheric pressure;

$P_1$—pressure in the camera for applying the coating;

$P_{m.col}$—pressure of the melt column above the lower side of the passage, the melt set higher of the passages 23 and 24 does not flow out through them.

Device 12 for applying the coating has a mean for melt level regulating in camera 13 for applying the coating. It is necessary to maintain melt level in camera 13 because of the fact that melt in camera is constantly expensed and melt level is tended to decrease. When melt level is decreased differential of air pressure and pressure in camera is increased (due to $P_{m.col}$ decreasing), which can cause air break (air bobbles) through input and output passages of the camera 13 to the camera. It is undesirable because spoils the process of applying the coating and can cause coating defects on the product. Besides, air babbles in melt will cause its contamination by oxide impurities. This contamination spoils conditions of coating formation and causes defects of the coating.

Mean for regulating the melt level in camera 13 comprises melt level detector 17, which gives electric signal. Signal from melt level detector goes to the system for pressure regulation, which provides constant melt level maintaining in camera 13 by means of compressor regulating air pressure in tank 14 with melt (any appropriate known system will do).

Melt level decreasing in camera 13 for applying the coating is registered by said melt level detector 17. Electric signal from melt level detector 17 controls work of pressure regulator, by means of which pressure in tank is smoothly increased and melt in camera 13 reaches the set level. At the same time melt level in tank 14 is decreased. When it reaches critically low level, the signal is given to add melt into the tank 14. Pressure discharge level in camera 13 is maintained on the set level by controlling the ejector airflow (is not shown on the drawings).

Constant pressure differential $\Delta = P_{at} - (P_1 + P_{m.col})$ in the camera for applying the coating is maintained for the same purpose.

Excessive pressure in the tank 14 drives melt to the camera for applying the coating through the intake vertical passage 20. The melt is set on the level higher input and output passages.

In the camera for applying the coating 12 pressure discharge is created, which helps to hold the melt from flowing out through input and output passages.

Discharge degree in the camera 12 is maintained on constant level for stable and reliable work of the device. For example, when discharge degree in the camera is decreased, discharge electric detector gives signal on electropneumatic valve, which is opened and increases airflow through ejector. When discharge degree in the camera 12 is increased, discharge electric detector gives signal on electropneumatic valve, which is closed and decreases airflow through ejector.

When the coating is applied, the melt in the camera is spent and melt level in the camera 12 is decreased. Melt level detector 17 serves for maintaining the set level in the camera. This detector 17 gives signal about increasing or decreasing of the melt level. Signal about increasing of the melt level in the camera for applying the coating opens electropneumatic valve, air is scoured from the camera and melt level is decreased. Signal about decreasing of the melt level in the camera for applying the coating opens electropneumatic valve, pressure in the tank with melt is increased and melt level in the camera is increased.

When product is transported through the melt, for example zinc or aluminum, protective coating is formed on the product surface. Direct product 2 transporting through the passages 23 and 24 of the camera 13 allows applying the coating without product deformation. In this case, the melt does not flow out the input and output passages of the camera.

In the output passage 24 of the device 12 there is a device for melt excess removing (not shown on the drawings). From the output passage 24 of the device 12 the product is supplied to the cooling camera 27, then through the transporting device and, if necessary, through the system of directing rollers wire is supplied to the winding device, where the final product is winded on the coil.

The main characteristic of the line work referring to the tubes and rolled products is in the fact, that in the range of cases the mechanical surface cleaning is enough before applying the coating. Thermo-chemical treatment and fluxing is used if necessary for speed increasing of applying the coating.

Another characteristic of the line work, referring to the tubes and rolled products, is the need to cut the product into fragments of needed length to stack them after applying the coating.

For tubes or rolled product (because of its complicated shape) it is possible to use device for melt excesses removing, which is placed not in the output passage 24 of the camera 12, but right after it.

The offered technology and devices for applying the coatings on rolled products and tubes will allow using tube and rolled product blanks of any specified length without using large-sized tanks for applying the coatings.

What is claimed is:

1. A method for applying a coating on a lengthy product, comprising:

providing a melt of coating material in a tank;

positioning a camera above the tank;

maintaining pressure in the camera below atmospheric pressure to prevent leaking of melt through a product inlet and product outlet in the camera;

moving the product through the melt in the camera; and maintaining pressure in the tank greater than the pressure in the camera whereby melt will move upwardly through a vertical passage having a lower end in the tank and an upper end in the camera.

2. The method of claim 1 further comprising maintaining a level of melt in the camera above the product inlet and outlet.

3. The method of claim 1 further comprising controlling the level of melt in the camera.

4. The method according to claim 1 wherein the coating material is selected from a group consisting of metal or alloy melt, and melt or solution of organic or inorganic substances or their mixes.

5. The method according to the claim 1 wherein the product is selected from a group consisting of wire, bar, rolled product, band (ribbon), tube, filament, yarn, and rope.

6. The method according to the claim 1 wherein the coating material is selected from a group consisting of aluminum, zinc, aluminum alloy, zinc alloy, tin, and lead.

* * * * *